US011814918B2

(12) United States Patent
Philpott et al.

(10) Patent No.: US 11,814,918 B2
(45) Date of Patent: Nov. 14, 2023

(54) FORCE DISSIPATION ASSEMBLY FOR USE WITH DISCONNECT TOOLS

(71) Applicant: HALLIBURTON ENERGY SERVICES, INC., Houston, TX (US)

(72) Inventors: Bryan Thomas Philpott, Missouri City, TX (US); Mathusan Mahendran, Rio de Janeiro (BR); Mohan Gunasekaran, Rio de Janeiro (BR); Radhakrishnan Murugamanickam, Rio de Janeiro (BR); Marco Antonio Dos Santos Fernandes, Rio de Janeiro (BR)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 497 days.

(21) Appl. No.: 17/051,713

(22) PCT Filed: Jan. 30, 2020

(86) PCT No.: PCT/US2020/015926
§ 371 (c)(1),
(2) Date: Oct. 29, 2020

(87) PCT Pub. No.: WO2021/150251
PCT Pub. Date: Jul. 29, 2021

(65) Prior Publication Data

US 2023/0098383 A1 Mar. 30, 2023

(30) Foreign Application Priority Data

Jan. 23, 2020 (BR) ..... 10 2020 0014358

(51) Int. Cl.
*E21B 29/00* (2006.01)
*E21B 17/06* (2006.01)
(Continued)

(52) U.S. Cl.
CPC ..... *E21B 29/00* (2013.01); *E21B 17/06* (2013.01); *E21B 31/00* (2013.01); *E21B 23/00* (2013.01)

(58) Field of Classification Search
CPC ..... E21B 17/06; E21B 17/07; E21B 17/073; E21B 17/076; E21B 29/00; E21B 31/00; E21B 23/00
See application file for complete search history.

(56) References Cited

U.S. PATENT DOCUMENTS 4,705,111 A 11/1987 Bourg
6,408,946 B1 6/2002 Marshall et al.
(Continued)

OTHER PUBLICATIONS

International Search Report and Written Opinion, PCT Application No. PCT/US2020/015926, dated Oct. 15, 2020.

*Primary Examiner* — Christopher J Sebesta
*Assistant Examiner* — Lamia Quaim
(74) *Attorney, Agent, or Firm* — Polsinelli PC

(57) ABSTRACT

A method for dissipating force within a tubing string including providing a severing device to a desired location within a tubing string; a cut zone along the length of the tubing, and a housing disposed along the length of tubing and sized to enclose the cut zone therein, wherein the housing includes a first end and a second end each forming a housing shoulder, severing the tubing at the cut zone using the severing device creating a first tubing section and a second tubing section; wherein the first tubing section and the second tubing section slide apart within the housing.

19 Claims, 6 Drawing Sheets

(51) Int. Cl.
*E21B 31/00* (2006.01)
*E21B 23/00* (2006.01)

(56) References Cited

U.S. PATENT DOCUMENTS

| | | | | |
|---|---|---|---|---|
| 9,945,189 | B2 | 4/2018 | Richards et al. | |
| 2008/0105436 | A1 | 5/2008 | Molina et al. | |
| 2009/0277690 | A1* | 11/2009 | Swinford | E21B 31/1135 175/296 |
| 2010/0170675 | A1 | 7/2010 | Daigle et al. | |
| 2014/0326513 | A1 | 11/2014 | Sallwasser et al. | |
| 2017/0191329 | A1* | 7/2017 | Swinford | E21B 31/18 |
| 2017/0328160 | A1* | 11/2017 | Arnaly | E21B 31/16 |
| 2018/0058156 | A1 | 3/2018 | Bergeron et al. | |
| 2018/0163474 | A1* | 6/2018 | Kartha | E21B 6/02 |

* cited by examiner

FORCE DISSIPATION ASSEMBLY FOR USE WITH DISCONNECT TOOLS

CROSS-REFERENCE TO RELATED APPLICATIONS

This application is a national stage entry of PCT/US2020/015926 filed Jan. 30, 2020, which claims the benefit of Brazilian application number 1020200014358 filed on Jan. 23, 2020, each of the aforementioned applications are expressly incorporated herein by reference in their entirety.

FIELD

The present disclosure relates to a method for tubing disconnect within a wellbore. In particular, the present disclosure relates to a method for the dissipation of energy or force released when tubing is disconnected within a wellbore.

BACKGROUND

Wellbores are drilled into the earth for a variety of purposes including tapping into hydrocarbon bearing formations to extract the hydrocarbons for use as fuel, lubricants, in chemical production, and other purposes. Various tools may be required downhole during the completion process of the wellbore. Such tools can include, for example, a packers, interval control valves, anchors, gauges, sand control assemblies, and the like, which can be disposed within the wellbore using a tubing or conveyance. Disconnection of a downhole tool from the tubing or conveyance can release significant force within the wellbore.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

During the drilling, completion, production, servicing and workover processes one or more downhole tools may be required to drill, complete, or produce the well. At various times, such as when a particular job that the downhole tool is used for is complete, such downhole tools may need to be detached from the tubing while the tubing is still disposed downhole. This may be carried out by severing the tubing at a location above the downhole tool. As the downhole tools are detached from the tubing, an excessive force, such as that experienced during a whiplash or slingshot-type event, can be released within the wellbore. The force can become trapped in the string due to a difference in temperature or pressure within the well. The release of the excessive forces can cause the disconnection of the tubing string to occur with great velocity and violence, which can cause damage to the lower completion tubing or any tools coupled with the lower completion tubing. Specifically, damage can be caused to seal surfaces and latching profiles; furthermore, debris can be shaken loose from the wellbore wall and settle in the lower completion tubing.

The present disclosure generally relates to methods and systems for dissipating the force released when downhole tubing is disconnected within a wellbore. For example, a force dissipation assembly can be coupled with the tubing string. The force dissipation assembly can include a housing coupled with the tubing of a tubing string and operable to provide a controlled release of force when the tubing is severed. The assembly, systems, and methods disclosed herein can be used to prevent damage to the tubing, downhole tools coupled therewith, and the wellbore wall.

Figure 1:
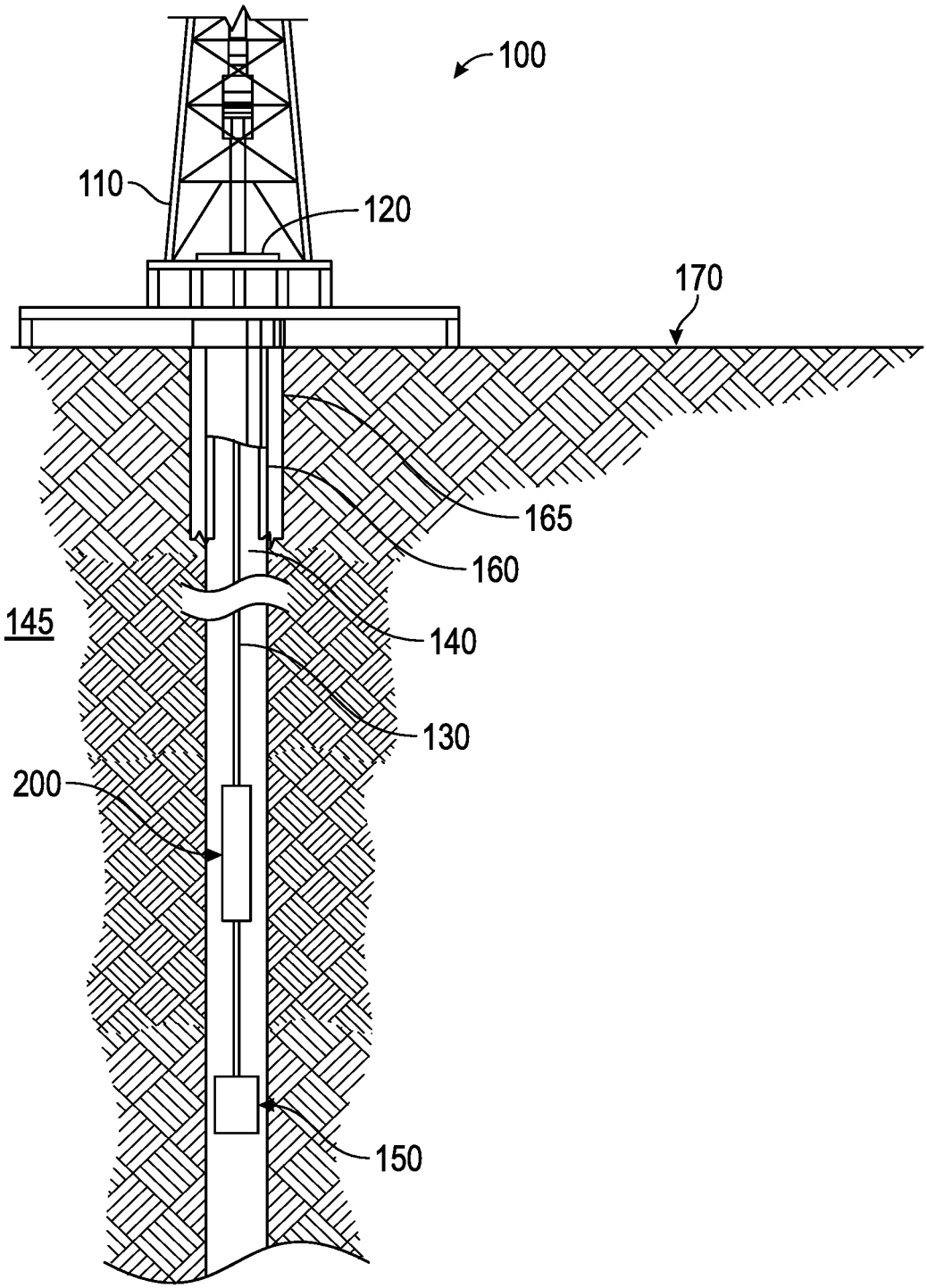
FIG. 1 is a is a schematic diagram of an exemplary operating environment compatible with the systems and methods as described herein.

FIG. 1 illustrates an exemplary environment compatible with the disclosed assembly, systems, and methods. Specifically, FIG. 1 illustrates a schematic view of an embodiment of a wellbore operating environment 100 in which the present disclosure may be implemented. As depicted in FIG. 1, the operating environment 100 can include a derrick 110 that supports a hoist 120. As depicted, a downhole tool 150 can be lowered into a wellbore 140 via a conveyance 130, depicted as a tubular conveyance, coupled with the hoist 120. Downhole tools operable with the methods and systems disclosed herein include, but are not limited to, completion tools such as packers, interval control valves, sliding sleeves, safety valves, chemical injection mandrels, seal assemblies, line hangers, disconnect tools, gauge mandrel, sand control assemblies, and any other completion accessory tools. In at least one example, the downhole tool 150 can be part of a work string or a completion string. Work string downhole tools operable with the methods and systems disclosed herein can include, but are not limited to, a service tool, a wash pipe, a reverse-out valve, a crossover tool, a setting tool, and other downhole tools known to those skilled in the art. In an alternative example, the downhole tool 150 can be a logging tool, a testing tool, a measurement tool, or the like. The wellbore 140 can descend through one or more subterranean formations 145 and may be lined with a casing 160, which can be secured within the wellbore 140 by cement 165. The conveyance 130 may be used to raise and lower downhole tool 150 into the wellbore 140 via the hoist 120. While the casing 160 and cement 165 are illustrated as terminating above the downhole tool 150, in at least some examples both the casing 160 and cement 165 can extend below the downhole tool 150. For example, the downhole tool 150 can be disposed within a full cased wellbore 140. The conveyance 130 may include, but is not limited to, tubular conveyances such as coiled tubing, joint tubing, drilling tubing, tubing strings, or other tubulars. The conveyance 130 provides support for the downhole tool 150 and may take the form of a work string or a completion string. In one or more embodiments, the conveyance 130 can enable communication between the downhole tool 150 and processors or controllers at the surface 170 outside the wellbore 140. For example, the conveyance 130 may include one or more wires, cables, telemetry systems (e.g. wireless systems using acoustic, electromagnetic, and/or mud pulse technology), or the like to provide a communicative coupling between the downhole tool 150 and a control or processing facility, not shown, at the surface 170. Power can also be supplied downhole via the conveyance 130.

The wellbore operating system 100 can further include a force dissipation assembly 200 disposed about the conveyance 130. The force dissipation assembly 200 can be operable to dissipate a disconnection force created when the conveyance 130 is severed within the wellbore 140. The force dissipation assembly 200 can be located at any predetermined location along the length of the conveyance 130.

Modifications, additions, or omissions may be made to FIG. 1 without departing from the spirit and scope of the present disclosure. For example, FIG. 1 depicts components of the wellbore operating environments in a particular configuration. However, any suitable configuration of components may be used. Furthermore, fewer components or additional components beyond those illustrated may be included in the wellbore operating environment without departing from the spirit and scope of the present disclosure. It should be noted that while FIG. 1 generally depicts a land-based operation, those skilled in the art would readily recognize that the principles described herein are equally applicable to operations that employ floating or sea-based platforms and rigs or sub-sea, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

Additionally, while FIG. 1. Indicates that the wellbore is in an operational stage, the assembly, method, and systems as described herein can also be implemented during drilling, completion, production, servicing and workover stages of the wellbore, or any process where a tubular is provided downhole.

An assembly, and methods and systems for using said assembly, operable to dissipate any forces trapped within the tubing when it is separated are presented herein. Specifically, the force dissipation assembly described herein can be coupled with a length of tubing such that when the tubing sections are disconnected downhole at a cut zone, the force released by the action is contained within the housing of the assembly. The methods described herein can be used to reduce potential damage to downhole tools and tubing when a portion of the tubing requires removal from the wellbore. An exemplary force dissipation assembly 200 as disclosed herein is shown in FIGS. 2A-C.

Figure 2A:
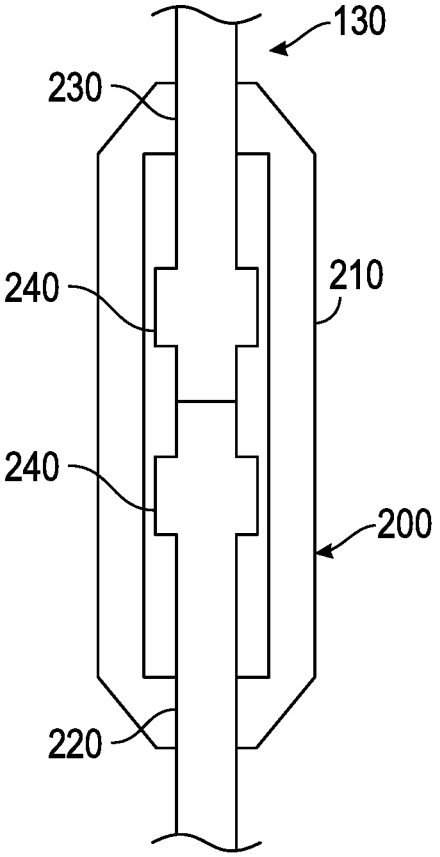
FIGS. 2A-D is are illustrative views of an exemplary assembly compatible with the systems and methods disclosed herein.

As shown in FIG. 2A, a force dissipation assembly 200, as shown in FIG. 1, can be disposed about a tubular, e.g. conveyance 130, allowing for the dissipation of tension or compression forces induced within the tubular. The force dissipation assembly 200 can include a housing 210 sized to fit a length of tubing therethrough. The tubing disposed within the housing 210 can be, in at least one example, the conveyance 130 can include a completion string having an upper tubing section 230 and a lower tubing section 220. The upper tubing section 230 and the lower tubing section 220 can be fluidically connected to one another via a plurality of couplers 240. The couplers 240 can include any suitable means for connecting a tubing string, the couplers 240 can be spaced to demarcate a cut zone therebetween. As shown, the plurality of couplers can protrude outward from and encircle the outer surface of the tubing string creating a plurality of coupler shoulders. The coupler shoulders can be sized such that they can move freely within, but cannot exit, the housing 210. After a completion string is disposed within a wellbore, pressure and temperature changes within the wellbore can cause the tubing string to shrink or expand. For example, as the tubing is constrained between the tubing hanger and a casing anchoring device, a reactive tension or compression force can be induced within the tubing. This induced force can then be released by severing the tubing within the assembly 200.

Figure 2B:
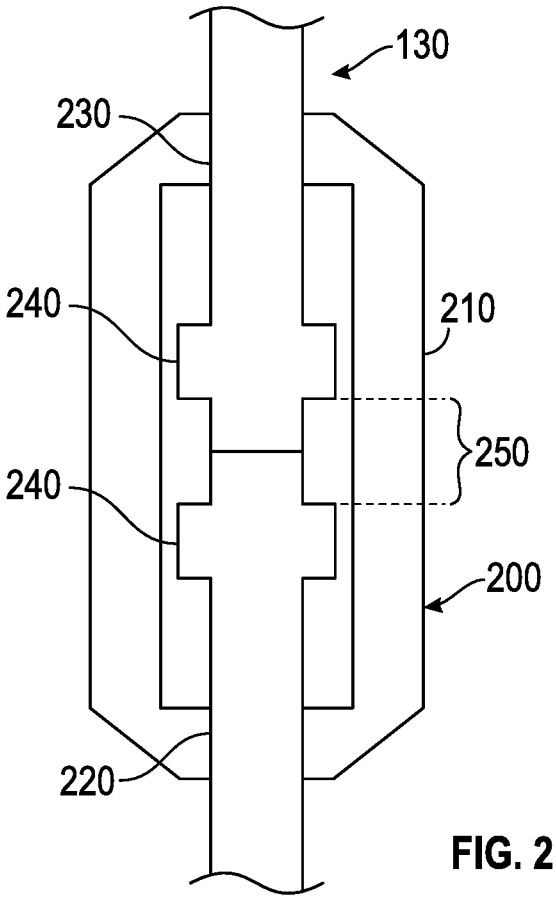
Figure 2C:
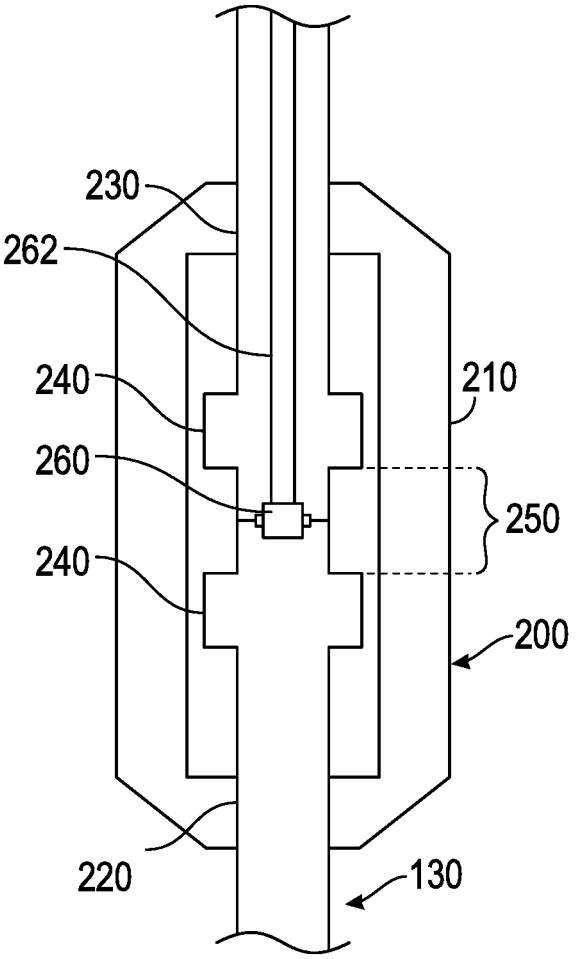

As shown in FIG. 2B, the upper tubing section 230 and the lower tubing section 220 can be disconnected within the housing 210, for example at cut zone 250. The cut zone 250 as illustrated in FIG. 2B can be of any length suitable for the system in which the assembly 200 is being utilized. In at least one example, the cut zone 250 can be at least a few feet in length. Additionally, the length of the housing can be adjusted based on the specific needs of the system. For example, the amount of tension within the tubing can be determined, and thus the distance the tubing would need to separate in order to release the tension can be calculated. For example, the housing can be designed to allow the tubing to slide from about four feet to about five feet apart. In an alternative example, the housing can be designed to allow the tubing to slide over ten feet apart. As shown in FIG. 2C, a severing device 260 can be lowered into the tubing via a conveyance 262 such that the severing device 260 aligns with the cut zone 250. The conveyance 262 can be any means suitable for lowering the severing device 260 within the tubing string; in at least one embodiment the conveyance can include a communication means operable to actuate the severing device 260. In at least one example the conveyance can be a wireline conveyance including, but not limited to, one or more wires, wireline, slickline, cables, tubulars, or the like. Once the severing device 260 reaches the desired location, the device can be actuated such that a stroke occurs causing the upper tubing section 230 to separate from the lower tubing section 220. While the severance apparatus is referred to herein as a "severing device" it should be recognized that any device suitable to cause the tubing to be severed can be utilized including, but not limited to, a cutting device, a slashing device, a shifting device, a puncture device, an explosive device, a chemical cutter, a plasma cutter, a pressure release device (including, but not limited to burst discs, shear pinned pistons, and the like), and any other device capable of separating the upper tubing section from the lower tubing section. Additionally, while the severing device described herein is stated as a separate device lowered into the tubing, it should be readily recognized by those in the art that the severing device could be built into the internal surface of the force dissipation assembly 200.

Figure 2D:
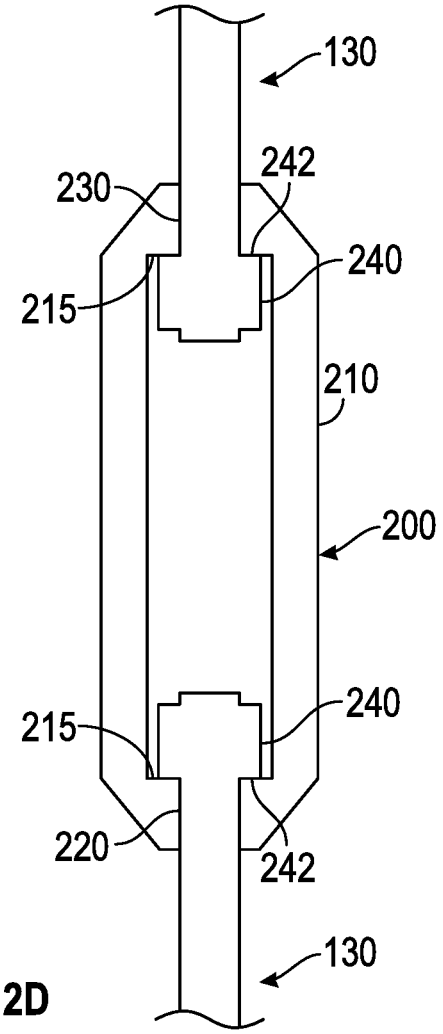

As the upper tubing section 230 and the lower tubing section 220 are separated the load trapped within the tubing is released into the housing 210 and allowed to dissipate. The housing 210 can further include a housing shoulder 215 at each of the top end and the bottom end of the housing 210. Once the tubing has been severed, as shown in FIG. 2D, the upper tubing section 230 and the lower tubing section 220 can slide apart and remain held within the housing by the outer shoulders 242 of each of the plurality of couplers 240 which abut each of the housing shoulders 215. The shoulders 242 of each of the plurality of couplers 240 can be dimensioned such that they can support the weight of the tubing portion after the severance has occurred.

Figure 3A:
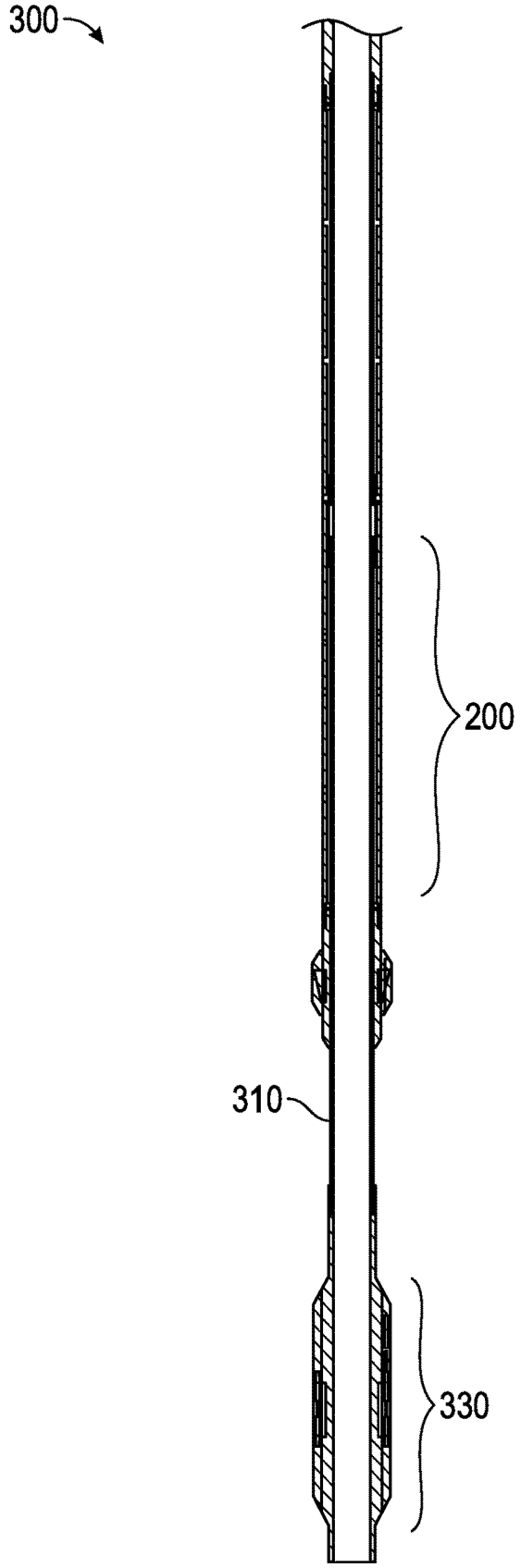
FIG. 3A is a cross-sectional view of an exemplary force dissipation assembly coupled with a completion string.

FIG. 3A illustrates a partial, cross sectional view of an example system wherein the force dissipation assembly 200 is coupled with a downhole tubing string 300, e.g. a work string or completion string. In at least one example, the completion string can be an intelligent completion string. As used herein, the term "intelligent completion" includes a completion string which includes control lines such that downhole tools can be controlled from a processing facility above ground. Specifically, the tubing string 300 can include tubing 310 coupled with a force dissipation assembly 200. In at least one example, the tubing string 300 can be a production string. The tubing string 300 can further include an accessory 330 coupled with the tubing 310. The accessory 330 can be any attachment to the tool including, but not limited to, control line cut subs, tubing anchors, tubing disconnects, packers (such as a production packer), seal bore assemblies, and the like. In at least one example, the accessory can be a tool which is to be permanently installed within the wellbore.

Figure 3B:
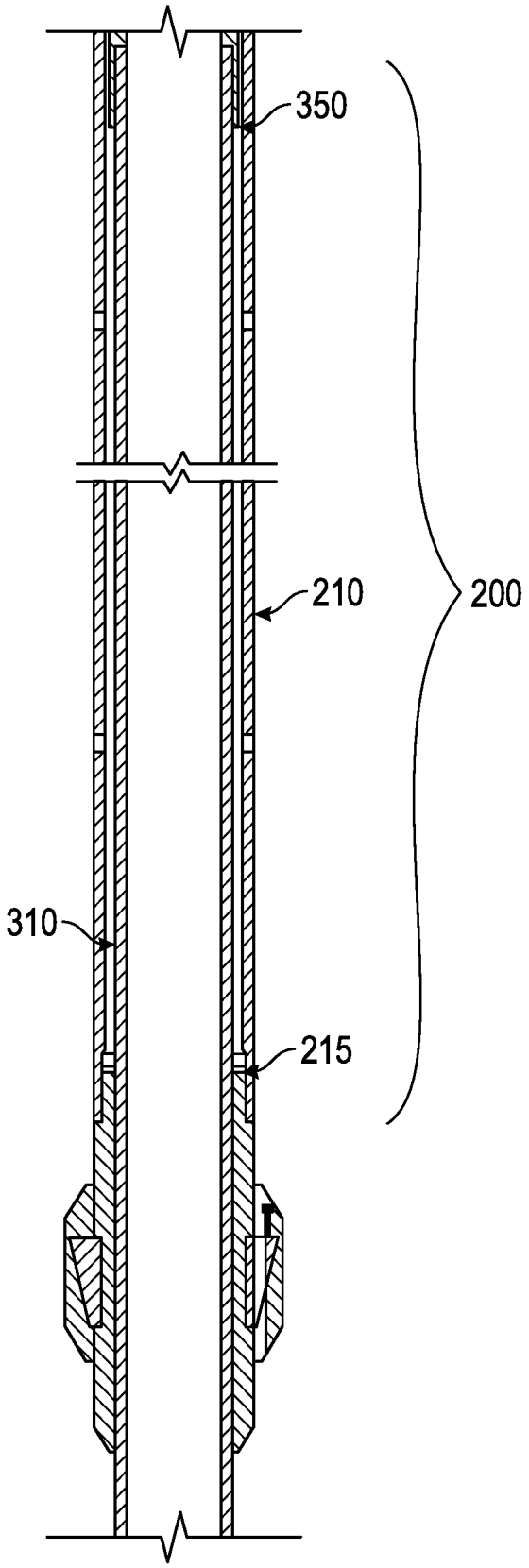
FIG. 3B is an enlarged view of the force dissipation assembly of FIG. 3A.

FIG. 3B illustrates an enlarged view of the force dissipation assembly 200 of FIG. 3A. As shown, the force dissipation assembly 200 can be disposed about the tubing 310. The force dissipation assembly 200 can include a housing 210 sized to be disposed about the tubing 310. The housing 210 of the force dissipation assembly 200 can demarcate a cut zone therein. In at least one example, (although not depicted) one or more threaded coupler (such as coupler 240 shown in FIGS. 2A-2D) can be included on either side of the cut zone of the tubing 310 within the force dissipation assembly 200. The force dissipation assembly 200 can include at least one shoulder 215 protruding radially inward from the housing 210, the shoulder 215 being sized to prevent a shoulder 350 on the tubing 310 from exiting the housing 210. As described above, the length of the force dissipation assembly 200 can be determined based on the space required to adequately release the tension from the tubing 310. The force dissipation assembly is shown having an indeterminate length, as described above the size of the force dissipation assembly can be adjusted based on the needs of the project.

It should be noted that while FIGS. 3A and 3B generally depict the force dissipation assembly within a completion string, those skilled in the art would readily recognize that the principles described herein are equally applicable to any type of tubing string including, but not limited to, a casing, a drill string, a coiled tubing, production tubing, and the like, without departing from the scope of the disclosure.

Figure 4:
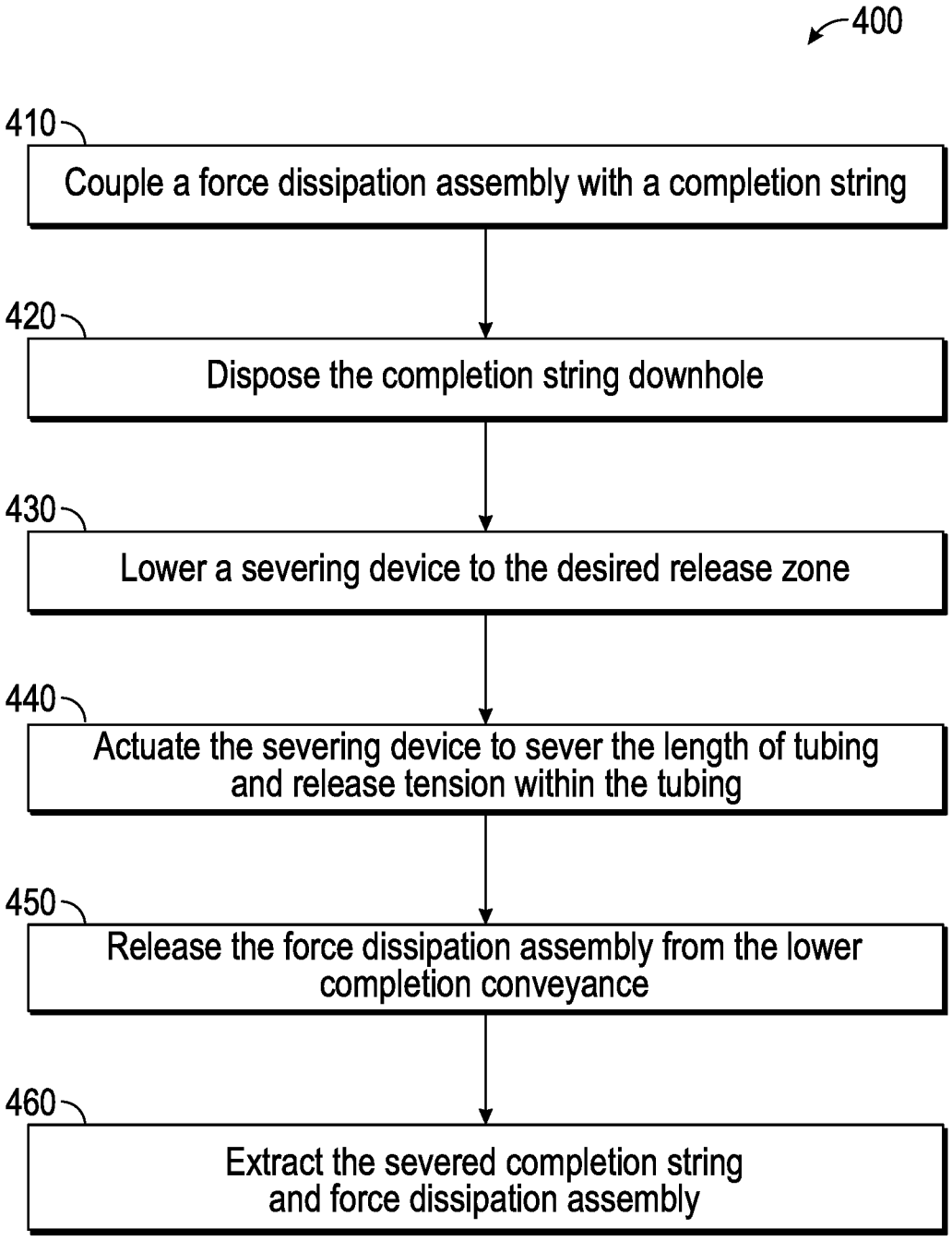
FIG. 4 is a flow chart illustrating a method for dissipating force within a tubing string compatible with the systems and assembly disclosed herein.

A method 400 for dissipating the force released by the disconnection of tubing within a tubing string is illustrated in FIG. 4. The method 400 is described with reference to FIGS. 1-3 and reference numbers associated therewith. The method 400 can begin at block 410 wherein a force dissipation assembly 200 is coupled with a tubing string 310. In at least one example, the tubing string 310 can be a completion or production string including, but not limited to, an upper tubing string, e.g. an upper completion, and a lower tubing string, e.g. a lower completion. In one or more embodiments, the upper and lower tubing strings can be divided by one or more production packers. In one or more embodiments, the force dissipation assembly 200 can be located along the upper tubing string, e.g., above at least one of the one or more production packer. As described in detail above, the force dissipation assembly 200 can be positioned such that it straddles a predetermined cut zone 250 within of the upper tubing string. The upper tubing string can be held within the force dissipation assembly 200 by a plurality of couplers 240 which can each have a shoulder sized 242 to abut a shoulder 215 of a housing 210 of the force dissipation assembly 200, such that the portions of the upper tubing cannot exit the housing 210 once severed. As described above, the force dissipation assembly 200 can be designed for use a specific environment. Specifically, the length of the housing 210 of the force dissipation assembly 200, and thus the distance between the housing shoulders 215 at each of the top end and the bottoms end of the housing 210, can be determined based on the distance the portions of the upper tubing must slide apart in order to release the tension within the tubing string 310.

At block 420, the tubing string 310, having the force dissipation assembly 200 coupled thereto, can be disposed within a wellbore. After the tubing string has been used for the desired purpose, it may be desirable to remove the upper tubing from the wellbore. At block 430 a severing device 260 can be lowered through the tubing string 310 to the cut zone 250 via any suitable means. The severing device 260 can be lowered to the desired cut zone 250 within the upper tubing, such that the severance can occur from within the tubing sting 310. At block 440, the severing device 260 can be actuated such that a stroke occurs from within the tubing string 310, severing the upper tubing into a first tubing section and a second tubing section. In at least one example, the severance of the tubing sections can be completed by actuating the severing device 260 at a control center uphole. Once the first tubing section and the second tubing section are severed, the tubing sections are able to slide away from one another within the bounds of the force dissipation assembly 200. As described above, the size of the force dissipation assembly 200 can be determined based on the amount of space necessary to allow the released tubing tension to be contained. After the first tubing section and the second tubing section are severed, the second tubing section can slide within the bounds of the housing 210 until a point of neutral force is achieved. Couplers 240 disposed about both the first and second tubing sections, as described above, can prevent the first and second tubing sections from exiting the housing 210 by abutting the shoulder 215 of the housing 210. While the first tubing section and the second tubing section of the upper tubing string are severed, the ends of each of the first tubing section and the second tubing section are still slidably connected via the force dissipation assembly housing 210. Additionally, as the temperature and pressures within the wellbore change, the first tubing section and the second tubing section can move throughout the bounds of the force dissipation assembly housing 210. In at least one example, the seal between the force dissipation assembly 200 and the upper tubing is fluid tight. In an alternative example, the seal between the force dissipation assembly 200 and the upper tubing is not fluid tight, in such example the internal pressure of the tubing and the annulus of the wellbore can be equalized after severance of the first tubing section and second tubing section of the tubing string 310.

Where the pressure between the annulus and upper tubing is equalized, there is no pressure differential which may potentially damage downhole tools when disconnected.

At block 450, the lower tubing can be released from the upper tubing at a point below the force dissipation assembly 200. In at least one example, the lower tubing can be disconnected by either shifting or releasing a tubing disconnection device located below the force dissipation assembly 200 along the tubing string 310. At block 460, the upper tubing, including at least the first tubing section, the second tubing section, and the force dissipation assembly 200, may be extracted from the wellbore using standard procedure. While previous methods, performed without the use of a force dissipation assembly, resulted in portions of the second tubing section remaining downhole, the present method allows for removal of the portion of the tubing between the severed point of the tubing and the disconnection point above the downhole tool without requiring a secondary fishing trip downhole. Specifically, as the severed tubing string is extracted from the wellbore, the assembly housing will bring the second tubing section uphole along with the first tubing section. As such, the force dissipation assembly 200 as described herein can act as a self-fishing device which can both relieve tubing tension and pressure differentials as well as retrieve the severed portion of the tubing. The term "self-fishing" as used herein refers to a device capable of removing debris or excess equipment created by the device from the wellbore. The force dissipation assembly 200, and the method described above, can significantly reduce the risk of damaging other downhole tools.

Numerous examples are provided herein to enhance understanding of the present disclosure. A specific set of statements are provided as follows.

Statement 1: A method for dissipating force within a tubing string comprising providing a severing device to a desired location within a tubing string, the tubing string comprising a length of tubing extending into a wellbore; a plurality of couplers disposed about the length of tubing and demarcating a cut zone therebetween, the plurality of couplers extending radially outward from the length of tubing, and a housing disposed along the length of tubing and sized to enclose the plurality of couplers therein, wherein the housing includes a first end and a second end, each of the first end and the second end forming a housing shoulder abutting the plurality of couplers, severing the tubing at the cut zone using the severing device creating a first tubing section and a second tubing section; and each of the first tubing section and the second tubing section having one of the plurality of couplers attached thereto, wherein when the tubing is severed the first tubing section and the second tubing section slide apart and the plurality of couplers on each of the first tubing section and the second tubing section abut the housing shoulder of the corresponding end of the housing.

Statement 2: A method according to Statement 1, wherein the housing is a self-fishing housing.

Statement 3: A method according to Statement 1 or Statement 2, wherein the tool string is an intelligent completion having an upper completion and a lower completion.

Statement 4: A method according to Statements 1-3, further comprising equalizing the pressure in an annulus disposed between the wellbore and the length of tubing.

Statement 5: A method according to Statements 1-3, further comprising not equalizing the pressure in an annulus disposed between the wellbore and the length of tubing.

Statement 6: A method according to Statements 1-5, wherein the severing device is selected from the group consisting of a cutting device, a slashing device, a shifting device, a puncturing device, an explosive device, a chemical cutter, a plasma cutter, a pressure release device, and combinations thereof.

Statement 7: A method according to Statements 1-6, wherein the pressure release device is selected from the group consisting of a burst disc, a shear pinned piston, and the like.

Statement 8: A method according to Statement 1-7, wherein the tubing string further comprises a downhole tool coupled with the length of tubing below the housing.

Statement 9: A method according to Statements 1-8, further comprising releasing the downhole tool from the first tubing section of the length of tubing below the housing.

Statement 10: A method according to Statements 1-9, wherein the extraction further comprises extracting the first tubing section and the second tubing section extending from the housing.

Statement 11: A force dissipation system comprising a tubing string comprising a length of tubing having an uphole end and a downhole end; a plurality of couplers disposed about the length of tubing and spaced to demarcate a cut zone therebetween, each of the plurality of couplers extending radially outward from the length of tubing; and a housing disposed about a portion of the length of tubing and enclosing the plurality of couplers therein, the housing having a first end and a second end, each of the first end and the second end creating a housing shoulder, wherein each of the housing shoulders are sized to abut the plurality of couplers to prevent the plurality of couplers from exiting the housing.

Statement 12: A force dissipation system in accordance with Statement 11, further comprising a severing tool disposed within the length of tubing.

Statement 13: A force dissipation system in accordance with Statement 12, further comprising an integrated severing tool.

Statement 14: A force dissipation system in accordance with Statements 11-13, wherein the severing device is selected from the group consisting of a cutting device, a slashing device, a shifting device, a puncturing device, an explosive device, a chemical cutter, a plasma cutter, a pressure release device, and combinations thereof.

Statement 15: A force dissipation system in accordance with Statements 11-14, wherein the pressure release device is selected from the group consisting of a burst disc, a shear pinned piston, and the like.

Statement 16: A force dissipation system in accordance with Statements 11-15, wherein the severing device is operable to sever the tubing into a first tubing section and a second tubing section.

Statement 17: A force dissipation system in accordance with Statements 11-16, wherein the housing is operable to equalize the pressure within the housing after the tubing is severed.

Statements 18: A force dissipation system in accordance with Statements 11-16, wherein the housing does not equalize the pressure within the housing after the tubing is severed.

Statement 19: A force dissipation system in accordance with Statements 11-18, wherein the housing is a self-fishing housing.

Statement 20: A force dissipation in accordance with Statements 11-19, wherein the tool string is an intelligent completion.

Statement 21: A wellbore environment comprising an intelligent completion disposed within a wellbore, the intelligent completion including an upper completion string and a lower completion string, the upper completion string including a length of tubing having an uphole end and a downhole end; a plurality of couplers disposed about the length of tubing and spaced to demarcate a cut zone therebetween, each of the plurality of couplers extending radially outward from the length of tubing; a housing disposed about a portion of the length of tubing and enclosing the plurality of couplers therein, the housing further comprises a first end and a second end, each end creating a housing shoulder; a severing device disposed within the intelligent completion and operable to move throughout the length of tubing.

Statement 22: A wellbore environment in accordance with Statement 21, wherein the length of tubing has one or more downhole tools coupled with the downhole end.

Statement 23: A wellbore environment in accordance with Statement 21 or Statement 22, wherein the severing device is operable to sever the length of tubing at the cut zone into a first tubing section and a second tubing section.

Statement 24: A wellbore environment in accordance with Statements 21-23, wherein the housing is operable to equalize the pressure between the severed tubing and an annulus of the wellbore.

Statement 25: A wellbore environment in accordance with Statements 21-23, wherein the housing does not equalize the pressure between the severed tubing and an annulus of the wellbore.

Statement 26: A wellbore environment in accordance with Statements 21-25, wherein the severing device is selected from the group consisting of a cutting device, a slashing device, a shifting, a puncturing device, an explosive device, a chemical cutter, a plasma cutter, a pressure release device, and combinations thereof.

Statement 27: A wellbore environment in accordance with Statements 21-26, wherein the pressure release device is selected from the group consisting of a burst disc, a shear pinned piston, and the like.

Statement 28: A wellbore environment in accordance with Statements 21-27, wherein when the length of tubing is severed the shoulder of each of the plurality of couplers abut each of the housing shoulders, preventing the plurality of couplers from exiting the housing.

Statement 29: A wellbore environment in accordance with Statements 21-28, wherein the housing is a self-fishing housing.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

We claim:

1. A method for dissipating force within a tubing string comprising:

providing a severing device to a desired location within a tubing string, the tubing string comprising:

a length of tubing extending into a wellbore, the length of tubing having a first tubing section and a second tubing section, a cut zone along the length of the tubing, a plurality of couplers disposed about the length of tubing and spaced to demarcate the cut zone therebetween, each of the plurality of couplers extending radially outward from the length of tubing, wherein the plurality of couplers is coupled with the length of tubing to fluidically connect the upper tubing section with the lower tubing section, and a housing disposed about a portion of the length of tubing and enclosing the cut zone and the plurality of couplers therein, wherein the housing includes a first end and a second end, each of the first end and the second end forming a housing shoulder, wherein each of the housing shoulders are sized to abut the plurality of couplers to prevent the plurality of couplers from exiting the housing; and severing the tubing at the cut zone using the severing device separating the the first tubing section and the second tubing section, wherein when the length of tubing is severed the first tubing section and the second tubing section slide apart within the housing, wherein an end of the first tubing section and an end of the second tubing section are coupled with the plurality of couplers such that the ends of first tubing section and the second tubing section are prevented from exiting the housing when the first tubing section and the second tubing section are separated at the cut zone by the severing device.

2. The method of claim 1, wherein the housing is a self-fishing housing such that the housing retains the plurality of couplers therein so that when the housing is retrieved, the plurality of couplers is also retrieved.

3. The method of claim 1, wherein the tubing string is a completion having an upper completion and a lower completion.

4. The method of claim 1, further comprising equalizing the pressure in an annulus disposed between the wellbore and the tubing.

5. The method of claim 1, wherein the severing device is selected from the group consisting of a cutting device, a slashing device, a shifting device, a puncturing device, an explosive device, a chemical cutter, a plasma cutter, a pressure release device, and combinations thereof.

6. The method of claim 1, wherein the tubing string further comprises a downhole tool coupled with the length of tubing below the housing.

7. The method of claim 6, further comprising releasing the downhole tool from the first tubing section of the length of tubing below the housing.

8. A force dissipation system comprising:

a tubing string comprising a length of tubing having an upper tubing section and a lower tubing section;

a plurality of couplers disposed about the length of tubing and spaced to demarcate a cut zone therebetween, each of the plurality of couplers extending radially outward from the length of tubing, wherein the plurality of couplers is coupled with the length of tubing to fluidically connect the upper tubing section with the lower tubing section; and a housing disposed about a portion of the length of tubing and enclosing the plurality of couplers therein, the housing having a first end and a second end, each of the first end and the second end creating a housing shoulder, wherein each of the housing shoulders are sized to abut the plurality of couplers to prevent the plurality of couplers from exiting the housing, wherein an end of the upper tubing section and an end of the lower tubing section are coupled with the plurality of couplers such that the ends of upper tubing section and the lower tubing section are prevented from exiting the housing when the upper tubing section and the lower tubing section are separated at a cut zone by a severing device.

9. The force dissipation system of claim 8, further comprising the severing device disposed within the length of tubing.

10. The force dissipation system of claim 9, wherein the severing device is selected from the group consisting of a cutting device, a slashing device, a shifting device, a puncturing device, an explosive device, a chemical cutter, a plasma cutter, a pressure release device, and combinations thereof.

11. The force dissipation system of claim 10, wherein the severing device is operable to sever the tubing into a first tubing section and a second tubing section.

12. The force dissipation system of claim 11, wherein the housing is operable to equalize the pressure within the housing after the tubing is severed.

13. The force dissipation system of claim 8, wherein the housing is a self-fishing housing such that the housing retains plurality of couplers therein so that when the housing is retrieved, the plurality of couplers is also retrieved.

14. A wellbore environment comprising:

an intelligent completion disposed within a wellbore, the intelligent completion including an upper completion string and a lower completion string, the upper completion string including a length of tubing having an upper tubing section and a lower tubing section;

a plurality of couplers disposed about the length of tubing and spaced to demarcate a cut zone therebetween, each of the plurality of couplers extending radially outward from the length of tubing, wherein the plurality of couplers is coupled with the length of tubing to fluidically connect the upper tubing section with the lower tubing section;

a housing disposed about a portion of the length of tubing and enclosing the plurality of couplers therein, the housing further comprises a first end and a second end, each end creating a housing shoulder;

a severing device disposed within the intelligent completion and operable to move throughout the length of tubing, wherein each of the housing shoulders are sized to abut the plurality of couplers to prevent the plurality of couplers from exiting the housing, wherein an end of the upper tubing section and an end of the lower tubing section are coupled with the plurality of couplers such that the ends of upper tubing section and the lower tubing section are prevented from exiting the housing when the upper tubing section and the lower tubing section are separated at a cut zone by the severing device.

15. The wellbore environment of claim 14, wherein the severing device is operable to sever the length of tubing at the cut zone into a first tubing section and a second tubing section.

16. The wellbore environment of claim 15, wherein the housing is operable to equalize the pressure in an annulus disposed between the wellbore and the tubing.

17. The wellbore environment of claim 15, wherein the severing device is selected from the group consisting of a cutting device, a slashing device, a shifting, a puncturing device, an explosive device, a chemical cutter, plasma cutter a pressure release device, and combinations thereof.

18. The wellbore environment of claim 15, wherein when the length of tubing is severed the shoulder of each of the plurality of couplers abut each of the housing shoulders, preventing the plurality of couplers from exiting the housing.

19. The wellbore environment of claim 14, wherein the housing is a self-fishing housing such that the housing retains plurality of couplers therein so that when the housing is retrieved, the plurality of couplers is also retrieved.

* * * * *